US006582871B2

(12) United States Patent
Pickering

(10) Patent No.: US 6,582,871 B2
(45) Date of Patent: Jun. 24, 2003

(54) TONER FUSING SYSTEM AND PROCESS FOR ELECTROSTATOGRAPHIC REPRODUCTION, FUSER MEMBER FOR TONER FUSING SYSTEM AND PROCESS, AND COMPOSITION FOR FUSER MEMBER SURFACE LAYER

(75) Inventor: Jerry A. Pickering, Hilton, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/879,674

(22) Filed: Jun. 12, 2001

(65) Prior Publication Data

US 2003/0059703 A1 Mar. 27, 2003

(51) Int. Cl.[7] ..... G03G 13/20
(52) U.S. Cl. ..... 430/124; 430/99; 428/421
(58) Field of Search ..... 430/124, 99; 428/450, 428/421

(56) References Cited

U.S. PATENT DOCUMENTS

| | | | |
|---|---|---|---|
| 3,452,181 | A | 6/1969 | Stryjewski |
| 3,498,596 | A | 3/1970 | Moser |
| 3,912,901 | A | 10/1975 | Strella et al. |
| 3,967,042 | A | 6/1976 | Laskin et al. |
| 4,011,362 | A | 3/1977 | Stewart |
| 4,029,827 | A | 6/1977 | Imperial et al. |
| 4,046,795 | A | 9/1977 | Martin |
| 4,064,313 | A | 12/1977 | Takiguchi et al. |
| 4,071,735 | A | 1/1978 | Moser |
| 4,101,686 | A | 7/1978 | Strella et al. |
| 4,185,140 | A | 1/1980 | Strella et al. |
| 4,199,626 | A | 4/1980 | Stryjewski et al. |
| 4,257,699 | A | 3/1981 | Lentz |
| 4,264,181 | A | 4/1981 | Lentz et al. |
| 4,272,179 | A | 6/1981 | Seanor |
| 4,372,246 | A | 2/1983 | Azar et al. |
| 4,515,884 | A | 5/1985 | Field et al. |
| 4,853,737 | A | 8/1989 | Hartley et al. |
| 4,905,050 | A | 2/1990 | Derimiggio et al. |
| 4,984,027 | A | 1/1991 | Derimiggio et al. |
| 5,017,432 | A | 5/1991 | Eddy et al. |
| 5,157,445 | A | 10/1992 | Shoji et al. |
| 5,217,837 | A | 6/1993 | Henry et al. |
| 5,247,336 | A | 9/1993 | Mills, III |
| 5,332,641 | A | 7/1994 | Finn et al. |
| 5,464,698 | A | 11/1995 | Chen et al. |
| 5,531,813 | A | 7/1996 | Henry et al. |
| 5,582,917 | A | 12/1996 | Chen et al. |
| 5,595,823 | A | 1/1997 | Chen et al. |

(List continued on next page.)

OTHER PUBLICATIONS

"High Temperature Degradation of Silicone Rubber Compounds in a Silicone Oil Environment", by A.W. Henry, Rubber Chemistry and Technology, American Chemical Society, Rubber Division, Akron, OH, vol. 56, pps. 83–92 (1982).
"Cab–O–Sil Untreated Fumed Silica Properties and Functions" Cabot Corp., Tuscola, IL (1978, 1993).
Silicon Compounds: Register and Review, 5th Edition, R.Anderson et al. (Eds.), United Chemical Technologies, Bristol, PA, pp. 59–75 (1991).
"Cab–O–Sil TS–530 Treated Fumed Silica" Cabot Corp, Tuscola, IL (1991; TSD–131, 10/98).
Davis et al., U.S. application No. 09/450,302, filed Nov. 29, 1999.
Pickering et al., U.S. application No. 09/879,466, filed Jun. 12, 2001.
Pickering, et al., U.S. application No., 09/879,585, filed Jun. 12, 2001.

*Primary Examiner*—John Goodrow

(57) ABSTRACT

A process for fusing toner to paper. This process employs a release fluid containing an aminofunctional polyorganosiloxane, and a fuser member having a fluoroelastomer fusing surface layer that contains $Fe_2O_3$ filler.

32 Claims, 2 Drawing Sheets

U.S. PATENT DOCUMENTS

| | | | | |
|---|---|---|---|---|
| 5,729,813 | A | | 3/1998 | Eddy et al. |
| 5,780,545 | A | | 7/1998 | Chen et al. |
| 5,824,416 | A | | 10/1998 | Chen et al. |
| 5,851,673 | A | | 12/1998 | Chen et al. |
| 5,853,893 | A | | 12/1998 | Chen et al. |
| 5,935,712 | A | | 8/1999 | Tan et al. |
| 5,998,033 | A | | 12/1999 | Tan et al. |
| 6,011,946 | A | | 1/2000 | Eddy et al. |
| 6,045,961 | A | | 4/2000 | Heeks et al. |
| 6,090,491 | A | | 7/2000 | Tan et al. |
| 6,096,429 | A | | 8/2000 | Chen et al. |
| 6,114,041 | A | | 9/2000 | Tan et al. |
| 6,203,917 | B1 | * | 3/2001 | Davis et al. ..... 430/99 |

* cited by examiner

TONER FUSING SYSTEM AND PROCESS FOR ELECTROSTATOGRAPHIC REPRODUCTION, FUSER MEMBER FOR TONER FUSING SYSTEM AND PROCESS, AND COMPOSITION FOR FUSER MEMBER SURFACE LAYER

CROSS-REFERENCE TO CONCURRENTLY FILED APPLICATIONS

Filed concurrently with this application are the application Ser. No. 09/879,585 entitled "Toner Fusing System and Process for Electrostatographic Reproduction", and the application Ser. No. 09/879,466 entitled "Surface Contacting Member for Toner Fusing System and Process, Composition for Member Surface Layer, and Process for Preparing Composition". These two concurrently filed applications are incorporated herein in their entireties, by reference thereto.

BACKGROUND OF THE INVENTION

1. Field of the Invention

The present invention relates to electrostatographic imaging and recording apparatus, and particularly to assemblies in these apparatus for fixing toner to the substrates.

2. Description of Background and Other Information

Generally in electrostatographic reproduction, the original to be copied is rendered in the form of a latent electrostatic image on a photosensitive member. This latent image is made visible by the application of electrically charged toner.

The toner thusly forming the image is transferred to a substrate, such as paper or transparent film, and fixed or fused to the substrate. The fusing of toner to substrate can be effected by applying heat, preferably at a temperature of about 90° C.–200° C.; pressure may be employed in conjunction with the heat.

A system or assembly for providing the requisite heat and pressure customarily includes a fuser member and a support member. The heat energy employed in the fusing process generally is transmitted to toner on the substrate by the fuser member. Specifically, the fuser member is heated; to transfer heat energy to toner situated on a surface of the substrate, the fuser member contacts this toner, and correspondingly also can contact this surface of the substrate itself. The support member contacts an opposing surface of the substrate. Accordingly, the substrate can be situated between the fuser and support members, so that these members can act together on the substrate to provide the requisite pressure in the fusing process.

During the fusing process toner can be offset from the substrate to the fuser member. Toner thusly transferred to the fuser member in turn may be passed on to other members in the electrostatographic apparatus, or to subsequent substrates subjected to fusing.

Toner on the fusing member therefore can interfere with the operation of the electrostatographic apparatus and with the quality of the ultimate product of the electrostatographic process. This offset toner is accordingly regarded as contamination of the fuser member, and preventing or at least minimizing this contamination is a desirable objective.

Release agents can be applied to fusing members during the fusing process, to combat toner offset. Further, fusing member surface layers can incorporate fillers for the purpose of strengthening the bonding of release agents to these surface layers, and thereby improving release properties.

U.S. Pat Nos. 4,257,699, 4,264,181, and 4,272,179 each discloses an exhaustive number of metals, metal alloys, metal salts, and metal oxides, including iron oxide, for use as fuser member surface layer fillers; these same patents also list hydroxy, epoxy, carboxy, amino, isocyanate, and mercapto functional polyorganosiloxanes all as being suitable release agents. U.S. Pat. No. 6,011,946 discusses the importance of employing the correct combination of surface layer material, filler, and release agent; this patent is directed to a fuser member with a polymeric outer layer including a zinc compound dispersed therein, and a specified aminofunctional polyorganosiloxane release agent overlaying this outer layer.

SUMMARY OF THE INVENTION

It has been discovered that the particular combination of release agents comprising aminofunctional polyorganosiloxane, used with fluoroelastomer fusing surface layers with ferric oxide filler, provides unexpectedly superior results, with respect to features such as resistance against toner offset and release activity. Fusing surface layers incorporating $Fe_2O_3$ have been found to exhibit a surprisingly high degree of interaction with the aminofunctional release agents as indicated, thereby enhancing the thickness of the protective layer that these release agents form on the fusing surface.

The assembly, or system, of the invention includes a fuser member. The fuser member comprises a fuser base and an overlaying fusing surface layer. The fusing surface layer comprises a fluoroelastomer and contains $Fe_2O_3$ particles. It can reside directly on the fuser base, or a cushion and/or other material can be interposed between the fuser base and the fusing surface layer.

The fuser member, or at least the fusing surface layer, is heated, thereby providing the requisite heat energy for the fusing process. A release agent comprising an aminofunctional polyorganosiloxane, preferably in the form of a fluid and most preferably an oil, is applied to the fusing surface layer. This layer contacts toner on a substrate to effect fusing of the toner to the substrate, and can further contact the substrate surface on which the toner resides.

A support member for cooperating with the fuser member can be employed. During the fusing process the substrate is positioned between the fuser member and the substrate, and they cooperate to exert pressure on the substrate. The fuser member and the substrate define a nip that the substrate passes through, thereby providing appropriate pressure for the fusing process.

DESCRIPTION OF THE INVENTION

Figure 1:
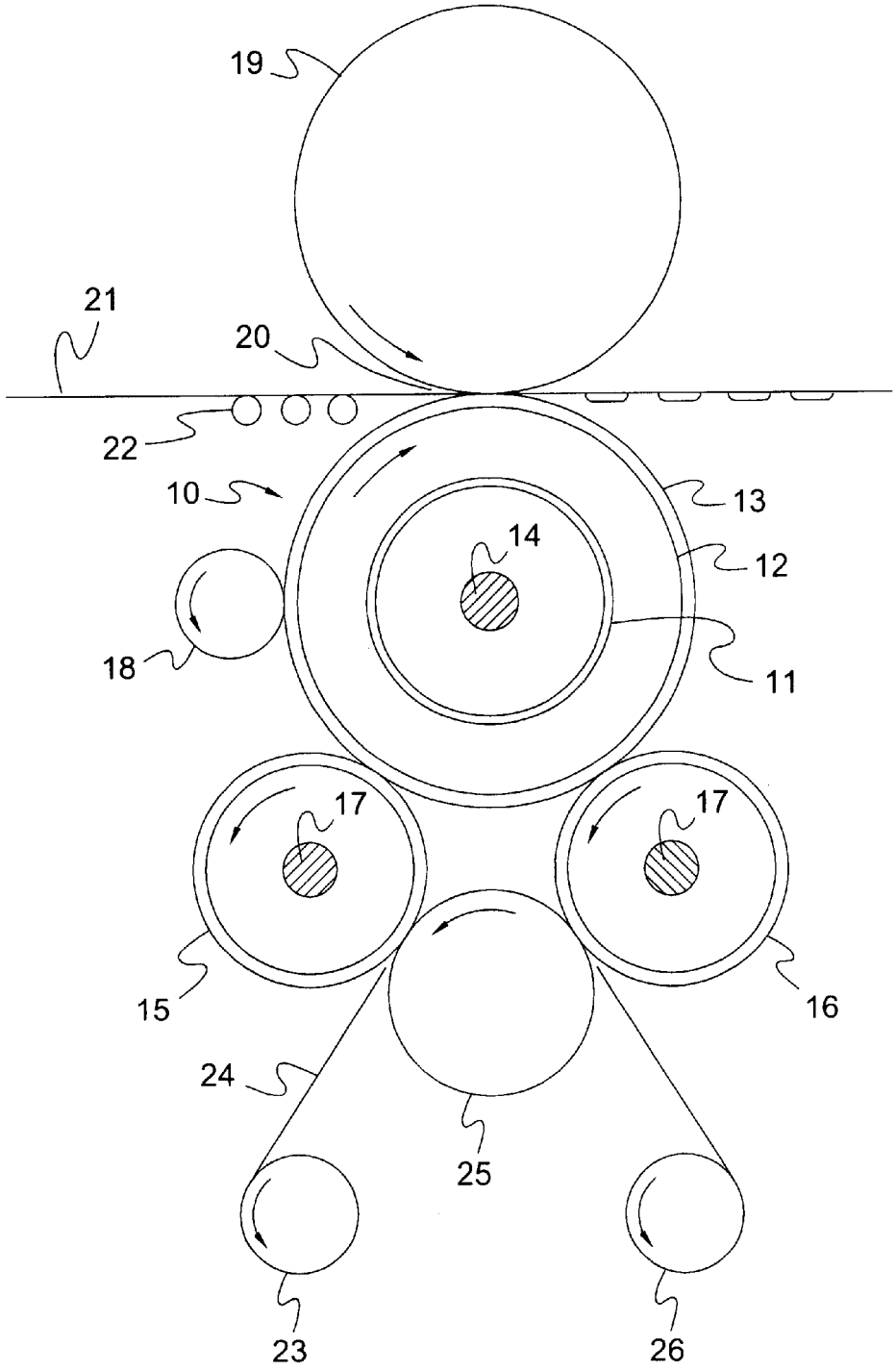
FIG. 1 is a schematic representation, and a sectional view, of a toner fusing assembly of the invention.

Copolymers are understood as including polymers incorporating two monomeric units, as well as polymers incorporating three or more different monomeric units, e.g., terpolymers, tetrapolymers, etc.

Polyorganosiloxanes are understood as including polydiorganosiloxanes—i.e., having two organo groups attached to each, or substantially each, or essentially each, of the polymer siloxy repeat units. Polyorganosiloxanes are further understood as including polydimethylsiloxanes.

The term "organo" as used herein, such as in the context of polyorganosiloxanes, includes "hydrocarbyl", which includes "aliphatic", "cycloaliphatic", and "aromatic". The hydrocarbyl groups are understood as including the alkyl, alkenyl, alkynl, cycloalkyl, aryl, aralkyl, and alkaryl groups. Further, "hydrocarbyl" is understood as including both non-substituted hydrocarbyl groups, and substituted hydrocarbyl groups, with the latter referring to the hydrocarbyl portion bearing additional substituents, besides the carbon and hydrogen. Preferred organo groups for the polyorganosiloxanes are the alkyl, aryl, and aralkyl groups. Particularly preferred alkyl, aryl, and aralkyl groups are the $C_1$–$C_{18}$ alkyl, aryl, and aralkyl groups, particularly the methyl and phenyl groups.

The fuser member includes a fuser base, and a fusing surface layer overlaying the fuser base. The fusing surface layer can reside directly on the fuser base. Alternatively, there can be one or more materials and/or layers, including one or more cushion layers, interposed between the fuser base and the fusing surface layer.

The fusing surface layer comprises at least one polyfluorocarbon elastomer, or fluoroelastomer, and iron oxide particles, particularly $Fe_2O_3$ particles. Particularly, the fusing surface layer comprises a polyfluorocarbon elastomer, or fluoroelastomer, having iron oxide particles, and especially $Fe_2O_3$ particles, dispersed therein as filler.

Suitable fluoroelastomers include random polymers comprising two or more monomeric units, with these monomeric units comprising members selected from a group consisting of vinylidene fluoride [—($CH_2CF_2$)—], hexafluoropropylene [—($CF_2CF(CF_3)$)—], tetrafluoroethylene [—($CF_2CF_2$)—], perfluorovinylmethyl ether [—($CF_2CF(OCF_3)$)—], and ethylene [—($CH_2CH_2$)—]. Among the fluoroelastomers that may be used are fluoro-elastomer copolymers comprising vinylidene fluoride and hexafluoropropylene, and terpolymers as well as tetra- and higher polymers including vinylidene fluoride, hexafluoropropylene, and tetrafluoroethylene monomeric units. Another suitable monomer is perfluorovinylmethyl ether.

Preferred fluoroelastomers include random polymers comprising the following monomeric units:

$$—(CH_2CF_2)_x—,\ —(CF_2CF(CF_3))_y—,\ \text{and}\ —(CF_2CF_2)_z—,$$

wherein x is from about 30 to about 90 mole percent, y is from about 10 to about 60 mole percent, and z is from about 0 to about 42 mole percent.

Further preferred fluoroelastomers are random polymers comprising the following monomeric units:

$$—(CH_2CH_2)_x—,\ —(CF_2CF(OCF_3))_y—,\ \text{and}\ —(CF_2CF_2)_z—,$$

wherein x is from about 0 to about 70 mole percent, y is from about 10 to about 60 mole percent, and z is from about 30 to about 90 mole percent The fluoroelastomers, as discussed, may further include one or more cure site monomers. Among the suitable cure site monomers are 4-bromoperfluorobutene-1, 1,1-dihydro-4-bromoperfluorobutene-1, 3-bromoperfluorobutene-1, and 1,1-dihydro-3-bromoperfluoropropene-1. When present, cure site monomers are generally in very small molar proportions. Preferably, the amount of cure site monomer will not exceed about 5 mole percent of the polymer.

The fluoroelastomer molecular weight is largely a matter of convenience, and is not critical to the invention. However, as a matter of preference, the fluoroelastomers have a number average molecular weight of from about 10,000 to about 200,000. More preferably they have a number average molecular weight of from about 50,000 to about 100,000.

Commercially available fluoroelastomers which may be used are those sold under the trademark Viton® by Dupont Dow Elastomers, Stow, Ohio; they include Viton® A, Viton® B, Viton® E, Viton® GF, Viton® GH, Viton® GFLT, Viton® B 50, Viton® B 910, Viton® E 45, Viton® E 60C, and Viton® E 430. Also suitable are the Tecnoflons®, such as T838K and FOR4391 from Ausimont USA, Inc., Thorofare, N.J., and the Fluorel™ fluoro-elastomers, such as FE5840Q, FLS5840Q, FX9038, and FX2530 from Dyneon L.L.C., Oakdale, Minn.

Appropriate fluoroelastomers include those as identified in U.S. Pat Nos. 4,372,246, 5,017,432, 5,217,837, and 5,332,641. These four patents are incorporated herein in their entireties, by reference thereto.

The Viton® A, Viton® GF, FE5840Q, and FX9038 fluoroelastomers are particularly preferred.

Fluoroelastomer preferably comprises from about 30 percent by volume to about 90 percent by volume of fluoroelastomer compositions used to prepare coating preparations of the invention. Fluoroelastomer likewise preferably comprises from about 30 percent by volume to about 90 percent by volume of fusing surface layers of the invention.

Figure 2:
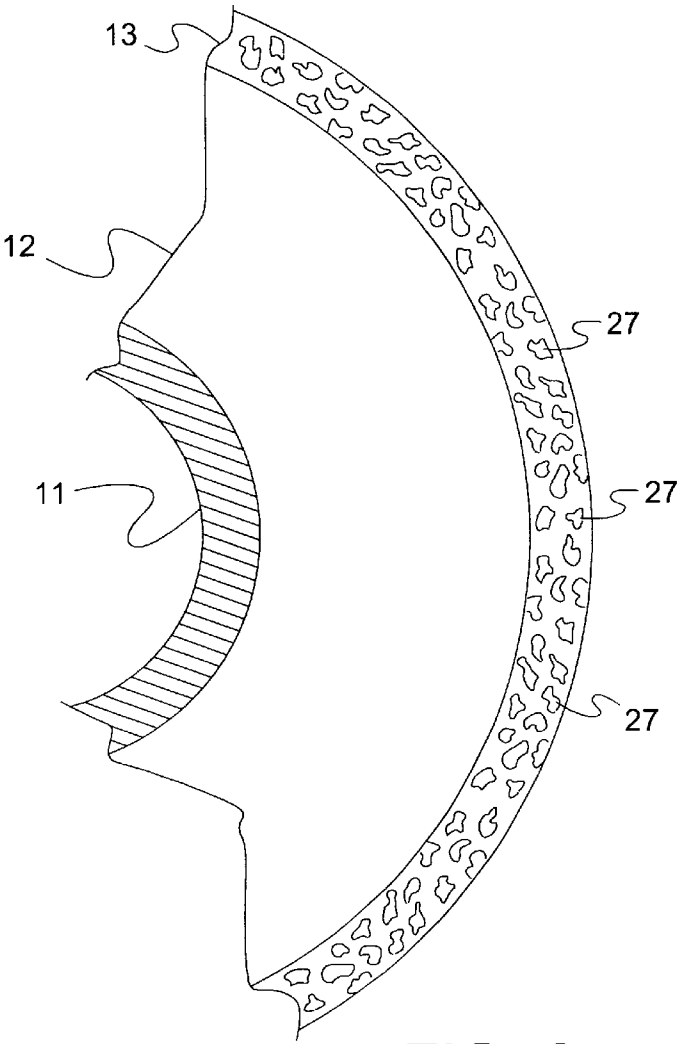
FIG. 2 is a schematic representation, and an enlarged fragmentary sectional view, of an embodiment of the fuser member of the invention.

The $Fe_2O_3$ may be natural or synthetic, and the $Fe_2O_3$ particles may be in one or more of any suitable shapes—irregular, as shown in FIG. 2, as well as in the form of spheroids, platelets, flakes, powders, ovoids, needles, fibers, and the like. Where internal heating is employed an irregular shape is more preferred, as are spherical particles and platelets, so as to maximize the heat conducting effect of the $Fe_2O_3$ particles; fibers, needles, and otherwise elongated shapes are less preferred here, unless they are advantageously oriented, because in certain alignments they are less effective for properly conducting heat.

In this regard, elongated particles are more efficient for conducting heat in the proper direction if they are at right angles to the fuser base—radially aligned, if the fuser base is a cylindrical core, belt on rollers, or a coremounted plate, but less efficient if they are positioned parallel to the core—axially aligned, if the fuser base is a core, a belt, or is core mounted as indicated. Accordingly, to maximize heat conducting properties where elongated $Fe_2O_3$ particles are employed, perpendicular (radial) positioning is preferred, while parallel (axial) alignment may be employed but is not preferred.

The $Fe_2O_3$ particles used in the present invention preferably have a mean particle diameter of from about 0.1 microns to about 80 microns, more preferably from about 0.1 microns to about 40 microns, still more preferably from about 0.1 microns or from about 0.2 microns to about 20 microns, still more preferably from about 0.2 microns to about 12 microns.

Generally as to filler, particles of smaller size are preferred because they provide increased reinforcement in the fusing surface layer. However, as discussed herein, forming the fusing surface layer on the fuser base involves placing the fluoroelastomer and the $Fe_2O3$ particles in solution. Decrease in filler particle size, and increase in surface area, tends to shorten solution life. Fillers, such as the Fe2O3, which are smaller than 2.0 microns can significantly reduce the solution processing life.

With respect to the foregoing, it has been discovered that $Fe2O_3$ prepared from sulfur-containing iron compounds— particularly by reaction, and especially chemical reaction, of these compounds—provides excellent solution life, even with smaller sized particles. In this regard, the indicated sulfur compound-derived $Fe_2O_3$, at sizes of less than 1 micron, may be used at high loading levels—for instance, in proportions of about 10 or higher volume percent of the fusing surface layer composition—and still show significant pot life.

Sulfur-containing iron compounds from which $Fe2O_3$ can be obtained include iron sulfates, particularly ferrous sulfate ($FeSO_4$). For instance, the $Fe_2O_3$ can be prepared by thermal decomposition of ferrous sulfate. $Fe_2O_3$ made in this manner is commercially available from Harcros Pigments Inc., Easton, Pa.

It is believed that the indicated extension of solution life is caused by trace amounts of sulfur, from the original sulfur containing iron compound, remaining with $Fe_2O_3$ produced therefrom. Small particle size and high surface area generally act to accelerate gelling and thereby destroy the solution, while sulfur interferes with fluoroelastomer curing, and accordingly retards the gelling process. If trace amounts of sulfur indeed are present, then apparently, as $Fe_2O_3$ particle size decreases and surface area correspondingly becomes greater, more of the sulfur is made available in the solution. A balancing effect accordingly seems to occur between the solution destroying and solution preserving factors, with the result thereby being a longer pot life. In any event, this explanation is provided only for the purpose of discussing the features of the invention as they are currently best understood, and it is not to be considered as limiting the scope of the invention.

Despite the foregoing, particles below 0.5 microns in size, including $Fe_2O_3$ prepared from sulfur-containing iron compounds, show a tendency to crepe harden and form insoluble gels in solution. With respect to the present invention, this disadvantageous characteristic can be overcome by solution milling. Specifically, where the $Fe_2O_3$ has a particle size below 0.5 microns, solution milling can be used to prepare the solution made with the fluoroelastomer and the $Fe_2O_3$ particles, for forming the fusing surface layer on the fuser base.

With very small filler particle sizes—specifically, less than 0.1 microns—gel formation can become severe for heavily loaded compositions. However, in the ordinary course, it can be expected that, even where it is not the intention to employ filler below this size, particles which indeed are smaller than 0.1 microns may be present in small amounts, or at incidental levels. Accordingly, $Fe_2O_3$ particles having a mean particle diameter of less than 0.1 microns are not preferred, particularly in amounts of about 5 percent by volume or more of the fusing surface layer.

Conversely, large-particle sizes—i.e., greater than 20 microns—produce rougher coatings, and have a greater tendency to settle out of solution. Settling can be reduced by using higher viscosity solutions, or by employing some form of continuous processing like continuous mixing, so that the particles are not be allowed to settle.

A type of iron oxide which should not be present, except at most in very small proportions, is hydrated ferric oxide, also known as yellow iron oxide. This form of iron oxide has the formula FeO(OH), and can adversely affect solution properties if there is too great an amount of it.

Hydrated ferric oxide can be present as part of a cocurative system with zinc oxide, such as the FeO(OH)/ZnO cocurative system of U.S. application Ser. No. 09/450,302, filed Nov. 29, 1999; this application is incorporated herein in its entirety, by reference thereto. However, this permissible use is with the proviso that FeO(OH) loadings remain within the relatively low levels at which cocuratives are employed. Preferably, FeO(OH) will not be present in an amount of more than about 30 parts per 100 parts by weight of the fluoroelastomer.

The $Fe_2O_3$ particles preferably are present, in the fusing surface layer, in an amount of at least about 15 parts per 100 parts by weight of the fluoroelastomer in this layer. $Fe_2O_3$ particles can comprise at least about 5 percent by volume, more preferably at least about 10 percent by volume, of the fusing surface layer. The $Fe_2O_3$ particles further can comprise from about 10 percent by volume to about 45 percent by volume, more preferably from about 10 percent by volume to about 40 percent by volume, still more preferably from about 10 percent by volume to about 35 percent by volume, and yet more preferably from about 10 percent by volume to about 30 percent by volume, of the fusing surface layer.

$Fe_2O_3$ filler of two or more different sizes or size ranges may be used. In this regard, as discussed herein, greater reinforcement is obtained with smaller particle sizes; also, the greater the amount of filler used, the more reinforcement is provided. Increase in reinforcement means that durability and hardness also increase. However, excessive hardness is not desirable. Also, more reinforcement means more brittleness, and even poor tear resistance at the extreme.

As with reinforcement, thermal conductivity also increases as the amount of filler used is increased—provided that distribution is at least relatively uniform. However, unlike reinforcement, thermal conductivity is not affected by the size of the filler particles employed.

Accordingly, reinforcement is amount and size dependent. Thermal conductivity is also amount dependent, but size independent.

A fusing surface layer may thusly include both smaller and larger size $Fe_2O_3$ filler particles. Specifically, the smaller size $Fe_2O_3$ filler particles can be present in an amount that maximizes reinforcement, or at least provides the requisite degree of reinforcement, but also keeps both hardness and brittleness within desired limits. The larger size filler particles can be included to provide additional thermal conductivity.

Where two different particle size ranges are used, the smaller particles may have a size range of from about 0.1 microns to about 10.0 microns, or from about 0.1 microns to about 5.0 microns, or from about 0.1 microns to about 1.0 micron or to about 2.0 microns, or from about 0.2 microns to about 1.0 micron or to about 2.0 microns. The larger particles may have a size range of from about 2.0 microns or from about 5.0 microns to about 80.0 microns, or from about 2.0 microns or from about 10.0 microns to about 40 microns, or from about 5.0 microns or from about 10.0 microns to about 20 microns.

With $Fe_2O_3$ particles of two different size ranges, the particles of the smaller size range can comprise from about 1 percent by volume to about 35 percent by volume, more preferably from about 5 percent by volume to about 25 percent by volume, still more preferably from about 10 percent by volume to about 20 percent by volume, of the fusing surface layer. Correspondingly, also as a matter of preference, the $Fe_2O_3$ particles of the larger size range can comprise all, or essentially all, or substantially all, of the remainder of the $Fe_2O_3$ particles of the fusing surface layer.

Preferably, the smaller $Fe_2O_3$ particles comprise the sulfur compound-derived $Fe_2O_3$ discussed herein. The larger $Fe_2O_3$ particles also can comprise $Fe2O_3$ prepared from a sulfur-containing iron compound.

For improving the wear resistance and release properties of the fusing surface layer, the $Fe_2O_3$ filler may be compounded with a coupling agent—preferably a silane coupling agent, as discussed in U.S. Pat. No. 5,998,033. In this regard, herein it is disclosed that the materials which are compounded, for subsequent dissolution and formation of the fusing surface layer, include the fluoroelastomer and the $Fe_2O_3$ particles. The requisite amount of coupling agent accordingly can be included in the compounding of these materials.

The $Fe_2O_3$ filler may instead be surface treated with a coupling agent—here also preferably a silane coupling agent, as discussed in U.S. Pat, Nos. 5,935,712, and 6,114,041. The coupling agent can be dissolved in an appropriate solvent, and surface treatment can be effected by steeping the $Fe_2O_3$ in this solution; ultrasonication can be employed during this treatment. After treatment the $Fe_2O_3$ is washed and dried. In the case of silane, preferably the treatment solution is prepared by adding about 2 weight percent of this coupling agent to a solvent comprising 95 percent by volume ethanol and 5 percent by volume water, and stirring for ten minutes. $Fe_2O_3$ filler is covered by the solution and ultrasonicated for ten minutes. The $Fe_2O_3$ then is separated by vacuum filtration, rinsed with ethanol, and thereafter oven dried at 150° C., for 18 hours under reduced pressure (vacuum).

It is understood that both surface treatment of $Fe_2O_3$ with coupling agent, and compounding $Fe_2O_3$ with coupling agent, are included in referring to treatment of $Fe_2O_3$ with coupling agent. It is further understood that both $Fe_2O_3$ compounded with silane coupling agent, and $Fe_2O_3$ surface treated with silane coupling agent, are included in referring to the resulting $Fe_2O_3$ product as silane coupling agent-treated $Fe_2O_3$.

Particularly as to the silane coupling agents, 3-aminopropyltriethoxysilane is a silane which may be employed. However, the secondary amine functional silanes are preferred, because they have relatively less of an unfavorable impact upon pot life. Suitable secondary amine functional silanes include N-phenylaminopropyltrimethoxysilane, N-phenylaminopropyltriethoxysilane, 3-[2-N-benzylaminoethyl-aminopropyltrimethoxysilane, and 3-[2-N-benzylaminoethylamino-propyltriethoxysilane.

U.S. Pat. Nos. 5,998,033, 5,935,712, and 6,114,041 are incorporated herein in their entireties, by reference thereto.

In addition to $Fe_2O_3$, one or more other types of fillers may be used with the fluoroelastomer for various purposes. Different fillers may be used for such purposes as conducting heat, controlling material properties such as wear resistance and surface roughness, modifying hardness, and imparting other characteristics, such as desired mechanical properties, to the fusing surface layer. Particularly, $Fe_2O_3$ may be used with one or more other fillers, such as $Al_2O_3$, $SnO_2$, SiC, CuO, ZnO, and amorphous silica, such as precipitated silica and fumed silica, to improve their toner offset and release properties.

Yet other additives and adjuvants also may be used with the fluoroelastomer, as long as they do not affect the integrity thereof, or significantly interfere with an activity intended to occur in the layer, such as the crosslinking of the fluoroelastomer. Suitable examples include reinforcing fillers, crosslinking agents, processing aids, accelerators, polymerization initiators, and coloring agents.

These further fillers, additives, and adjuvants, where present, are provided in amounts and proportions as are generally known or as can be determined without undue experimentation by those of ordinary skill in the art.

Particularly as to fillers other than $Fe_2O_3$, the particle shapes and sizes suitable for $Fe_2O_3$ also apply to these other fillers.

For preparation of the fusing surface layer, or fluoroelastomer layer, one or more curing agents or curatives are employed in a suitable amount to effect curing of the fluoroelastomer. Suitable curatives for the fluoroelastomer include nucleophilic addition curing systems. Also appropriate as curatives are free radical initiator curing systems.

Preferred nucleophilic addition curing systems for the fluoroelastomer are the bisphenol curing systems. These preferably include at least one bisphenol crosslinking agent and at least one accelerator.

Suitable bisphenol crosslinking agents include 4,4-(hexafluoroisopropylidene)diphenol, also known as bisphenol AF, and 4,4-isopropylidenediphenol. Accelerators which may be employed include organophosphonium salt accelerators such as benzyl triphenylphosphonium chloride.

The amount of bisphenol crosslinking agent used, and likewise the amount of accelerator used, each is preferably from about 0.5 parts to about 10 parts per 100 parts by weight of the fluoroelastomer. A bisphenol curing system, taken as a whole, is employed in an amount, based on the total weight of crosslinking agent and accelerator, likewise of from about 0.5 parts to about 10 parts per 100 parts by weight of the fluoroelastomer. A commercially available bisphenol curing system which may be used is Viton® Curative No. 50 from Dupont Dow Elastomers, which is a combination of bisphenol AF and one or more quaternary phosphonium salt accelerators; this curative preferably is used in an amount of from about 2 parts to about 8 parts per 100 parts by weight of the fluoroelastomer.

Further nucleophilic addition curing systems are polyfunctional hindered curing systems, particularly diamine curing systems. Among the diamine curing systems that may be employed are diamine carbamate curing systems. Examples of these are hexamethylenediamine carbamate and N,N'-dicinnamylidene-1,6-hexanediamine; these are commercially available as DIAK No. 1 and DIAK No. 3, respectively, from E.I. Du Pont de Nemours, Inc. DIAK No. 4 is another polyfunctional hindered diamine curing system that may be used.

Free radical initiator curing systems which may be used include peroxide free radical initiator curing systems. Preferably these comprise at least one peroxide free radical initiator, and at least one suitable crosslinking agent; peroxides that may be employed for this purpose include the suitable aliphatic peroxides.

Particular peroxides which may be used include ditertiary butyl peroxide, dicumyl peroxide, 2,4-dichlorobenzoyl peroxide, 2,5-dimethyl-2,5-di(t-butyl peroxy)hexane, dibenzoyl peroxide and the like. Particular crosslinking agents suitable for these systems include triallyl cyanurate, triallyl isocyanurate, and others known in the art.

Where the curative comprises a nucleophilic addition curing system or a free radical initiator curing system, one or more cocuratives may also be employed. In this regard, the use of these systems for curing fluoroelastomers can generate hydrogen fluoride. Accordingly, acid acceptors for neutralizing the hydrogen fluoride are suitable cocuratives. Preferred examples of these acid acceptors are the Lewis bases, particularly inorganic bases such as magnesium oxide, zinc oxide, lead oxide, calcium oxide and calcium hydroxide.

Also suitable as a cocurative is the cocurative system disclosed in U.S. application Ser. No. 09/450,302, filed Nov. 29, 1999.

The amount of cocurative which is used preferably is from about 2 parts to about 20 parts per 100 parts by weight of the fluoroelastomer. Particularly where one or more acid acceptors is employed, the amount used is preferably that which is sufficient to neutralize the indicated hydrogen fluoride and allow for complete crosslinking. However, an excessive amount of cocurative, particularly in the case of the more basic curatives such as calcium hydroxide, will shorten the life of the fluoroelastomer solution used to coat the cushion-bearing or noncushion-bearing fuser base, as discussed herein. Specifically, cocurative excess will cause rapid viscosity increase and solution gellation.

Magnesium oxide and zinc oxide are preferred acid acceptors.

A fluoroelastomer composition, such as is used for preparing the fluoroelastomer solution or dispersion of the invention, can comprise the fluoroelastomer and $Fe_2O_3$ filler. It can also include one or more of those of the foregoing curative, cocurative, additional filler, adjuvant, and additive components that are being employed.

As an embodiment of the invention, this composition in particular can comprise the fluoroelastomer, $Fe_2O_3$, and curative. This embodiment further can include one or more of the other components as indicated.

The indicated fluoroelastomer composition may be formed by any means suitable for combining the components. An appropriate dry compounding method is preferred.

Dry compounding may be conducted with a two roll mill. It may be carried out at a temperature of from about 40° F. to about 200° F., or from about 50° F. to about 100° F. However, preferably the compounding is carried out at approximately room temperature, for example, from about 50° F. to about 70° F. (from about 10° C. to about 21° C.), more preferably from about 55° F. to about 65° F. (from about 13° C. to about 28° C.). This operation tends to generate heat, so preferably a mill with its operating temperature inhibited by some means, such as by water cooling, is employed. The materials are compounded until a uniform, dry, flexible composite sheet is obtained.

Commercially provided fluoroelastomers often come with curatives already incorporated therein. However, it is preferred that the curative not be provided in this manner, but rather be employed as a separate component.

Although curative, as such a separate component, may be dry compounded with the other indicated components, preferably it is not, but rather is subsequently added to the solution which is prepared using the dry compounded materials, as discussed herein. Specifically, the curative may be added directly to the solution prior to coating. Withholding the curative thusly for addition to the final coating solution greatly extends this solution's shelf life.

For forming the requisite layer on the fuser member, the fluoroelastomer composition can be combined with suitable solvent. Specifically in the case of the fluoroelastomer composition obtained from dry compounding, this composition is divided into pieces and added to a sufficient amount of one or more solvents to provide a solution, or a dispersion. Further components may also be added.

For instance, one or more of the polydiorganosiloxane oligomers, particularly the $\alpha,\chi$ difunctional polydiorganosiloxanes, disclosed in U.S. Pat. No. 4,853,737 may be employed in the amount of about 0.1 to 5 grams per 100 grams of solution; this patent is incorporated herein in its entirety, by reference thereto. Particularly, the fluoroelastomer with pendant polydiorganosiloxane segments disclosed in this patent is suitable as the fluoroelastomer component of the present invention.

Further, one or more of the curable siloxane polymers, particularly the curable polyfunctional poly($C_{1-6}$ alkyl)-siloxane polymers, disclosed in U.S. Pat. No. 5,582,917, may be employed in the amount of 5 parts to about 80 parts per hundred parts by weight of the fluoroelastomer; this patent is incorporated herein in its entirety, by reference thereto. A preferred commercially available curable siloxane polymer is SFR-100 silicone, from GE Silicones, Waterford, N.Y. Particularly, the fluorocarbon copolymer-siloxane polymer composite disclosed in this patent is suitable as the fluoroelastomer component of the present invention.

If both polydiorganosiloxane oligomer and curable siloxane polymer, as discussed, are employed, it is preferable that they be kept separate prior to addition to the fluoroelastomer, because these polydiorganosiloxane oligomers catalyze the crosslinking of the curable siloxane polymers.

Still further, one or more yet additional additives and/or adjuvants can be added to the solution, such as defoaming agents, wetting agents, and other materials. These yet additional adjuvants and fillers, where present, are provided in amounts and proportions as are generally known or as can be determined without undue experimentation by those of ordinary skill in the art.

The amount of solvent used is preferably that which will provide a solution or dispersion having a solids content of from about 10 weight percent to about 50 weight percent, more preferably from about 10 weight percent to about 30 weight percent. Suitable solvents include esters and acetates such as acetone, methyl ethyl ketone (MEK), methyl isobutyl ketone, and mixtures thereof. Most preferably the solvent is MEK.

Also suitable as a solvent is one comprising 50 weight percent each of methyl ethyl ketone and methyl isobutyl ketone. Yet other solvents which may be used are blends of methyl ethyl ketone and methanol (MeOH), such as blends comprising about 85 percent by weight methyl ethyl ketone and about 15 percent by weight methanol (85:15 MEK:MeOH). Methanol is used to extend the solution life of the coating, or to improve the coating quality.

What is accordingly obtained is a coating composition —e.g., a coating solution or a coating dispersion—for preparing a fusing surface layer of the invention. With curative being present therein as indicated, it can be designated a curable composition.

The solution or dispersion may be applied to the fuser base in a succession of thin coatings, either as discrete layers or as a continuous buildup of layers. Application is by any suitable means, such as dipping, spraying, or transfer coating.

A method of dipping is ring coating. To conduct ring coating, the roller is drawn up through a larger diameter hole machined in two plates, a top plate and a bottom plate. Between the plates is a flexible gasket which forms a liquid tight seal with the roller surface and the top plate. The coating solution is poured into a well created by the roller, the flexible gasket, and the top plate. The roller is drawn up through the gasket and the solution coats the outside of the roller surface. In this manner a minimal amount of solution is used to coat each roller.

After it is applied, each coating is allowed to stand, at room temperature or higher, in order to flash off all or at least most of the solvent. For instance, following each application of a coating layer, evaporation of solvent is effected at temperatures of from about 25° C. to about 90° C. or higher.

When the desired thickness is obtained the resulting layer is cured. Preferably, the layer is heated to a temperature of from about 150° C. to about 250° C. and held for 12 to 48 hours. To prevent bubbling of the layer, either sufficient drying time is allowed for the indicated solvent flash off or evaporation to be completed, or the ramp to cure temperature—i.e., from room temperature to the stated 150° C.–250° C. upper limit—is extended over a period of 2 to 24 hours.

The number of coatings applied to form the fusing surface layer is that which will provide the appropriate thickness, which can be within a range as is conventional in the art. Specifically, the fusing surface layer can be of a thickness as is suitable for the systems and processes in which it is employed, and the requisite thickness for particular instances can be determined without undue experimentation.

The fusing surface layer disclosed herein can be provided in a thickness within any of the ranges which are taught, in the application Ser. No. 09/879,585, as being suitable for the toner fusing system and process of that application. Where it thusly is provided in a thickness within any of those ranges, the fusing surface layer disclosed herein indeed can be used with that toner fusing system and process.

In the operation of the toner fusing system of the present invention, release agent is applied to the fusing surface layer so that this agent contacts toner on the substrate, and can also contact the substrate, during the operation of the fuser member. Particularly where the fuser base is a cylindrical roller or an endless belt, the release agent is applied, while the base is rotating or the belt is running, upstream of the contact area between fuser member and substrate toner.

Preferably the release agent is applied so as to form a film on the fusing surface layer. As a matter of particular preference, the release agent is applied so as to form a film that completely, or at least essentially or at least substantially, covers the fusing surface layer. Also as a matter of preference, during operation of the system the release agent is applied continuously, or at least essentially or at least substantially continuously, to the fusing surface layer.

Release agents are intended to prohibit, or at least lessen, offset of toner from the substrate to the fusing surface layer. In performing this function, the release agent can form, or participate in the formation of, a barrier or film that releases the toner. Thereby the toner is inhibited in its contacting of, or even prevented from contacting, the actual fusing surface layer, or at least the fluoroelastomer thereof.

The release agent can be a fluid, such as an oil or a liquid, and is preferably an oil. It can be a solid or a liquid at ambient temperature, and a fluid at operating temperatures.

The release agent further is, or consists of, or consists essentially of, or consists substantially of, or comprises, one or more aminofunctional polyorganosiloxanes, such as aminofunctional polydimethylsiloxanes. Aminofunctional polyorganosiloxanes which can be used include those with one or more pendant amino groups and/or one or two terminating amino groups—it also being understood that pendant groups are side groups, or moieties attached along the backbone of the polymer chain, and terminating groups are end groups, or moieties attached at the polymer chain ends.

The suitable amino groups include amino groups with one nitrogen atom, and those with more than one nitrogen atom. They include primary, secondary, and polar amino groups, particularly polar primary and secondary amino groups. In this regard, suitable amino groups include aminohydrocarbyl groups, such as primary and secondary aminohydrocarbyl groups.

Suitable primary aminohydrocarbyl groups include groups with —$NH_2$ bonded to a hydrocarbyl group, which in turn is bonded to the silicon atom of the siloxy repeat unit. Suitable secondary aminohydrocarbyl groups include hydrocarbylaminohydrocarbyl groups, such as groups with —NH bonded to a hydrocarbyl group along with the indicated hydrogen atom, and also bonded to a hydrocarbyl group that in turn is bonded to the silicon atom of the siloxy repeat unit.

Suitable primary and secondary aminohydrocarbyl groups include primary and secondary aminoalkyl groups, such as $C_1$–$C_{18}$ aminoalkyl groups. Particular groups which are preferred include aminopropyl groups, such as the aminoisopropyl group and the 3-aminopropyl ($H_2NCH_2CH_2CH_2$—) group, and groups such as the methylaminopropyl, ethylaminopropyl, benzylaminopropyl, and dodecylaminopropyl groups. Another particular aminoalkyl group that is suitable is $H_2NCH_2CH_2$—NH—$CH_2CH_2CH_2$—.

The aminofunctional polyorganosiloxanes preferably have a number average molecular weight of from about 4,000 to about 150,000. More preferably they have a number average molecular weight of from about 8,000 to about 120,000.

Aminofunctional polyorganosiloxanes that are preferred are the monoaminofunctional polyorganosiloxanes—these being polyorganosiloxanes having one amino functional group per molecule or polymer chain. Suitable monoaminofunctional polyorganosiloxanes include those wherein the sole amino group is a side group; however, the preferred monoaminofunctional polyorganosiloxanes are those which are amino group terminated—i.e., wherein the sole amino functional group is at an end of the polymer chain.

An especially preferred monoaminofunctional polyorganosiloxane is an amino terminated monoaminofunctional polydimethylsiloxane that is terminated at one end with a 3-aminopropyl group, and at the other end with a trimethyl siloxy group. This amino terminated monoaminofunctional polyorganosiloxane has a number average molecular weight preferably of from about 10,000 to about 14,000; more preferably, of about 12,000.

An advantage of monofunctionality here is that there is only the one functional site available for interaction. Monoaminofunctional polyorganosiloxane accordingly does not have multiple sites for adhering both to the fusing surface layer and to toner, or to dirt, debris, or other contaminants; it therefore can not serve to hold these materials to the layer surface—i.e., as a toner/fuser member or contaminant/fuser member "adhesive". And particularly, monoaminofunctional polyorganosiloxane already in interaction with the layer surface accordingly is not available in this manner.

Aminofunctional polyorganosiloxanes therefore preferably comprise as great a molar proportion of monoaminofunctional polyorganosiloxanes as is practically possible. The most preferred aminofunctional polyorganosiloxanes accordingly are those which are exclusively monofunctional, or at least consist essentially of, or consist substantially of, monoaminofunctional polyorganosiloxanes.

However, in practice it is difficult to limit the polymer to the monofunctional chains. Accordingly, as a matter of preference the aminofunctional polyorganosiloxanes are predominantly monoaminofunctional polyorganosiloxanes, or at least comprise a majority of monoaminofunctional polyorganosiloxanes as a molar proportion. The term "predominantly" is understood referring to greater than 85 mole percent—i.e., more than 85 percent of the polymer chains. A majority as a molar proportion means more than 50 mole percent.

Preferably, in addition to one or more aminofunctional polyorganosiloxanes, the release agent also comprises one or more nonfunctional polyorganosiloxanes; particularly, the release agent can be a blend of these aminofunctional and nonfunctional polyorganosiloxanes. Preferred aminofunctional polyorganosiloxanes are aminofunctional polydimethylsiloxanes, and preferred nonfunctional polyorganosiloxanes are nonfunctional polydimethylsiloxanes.

It is understood that functional polyorganosiloxanes are polyorganosiloxanes having functional groups such as, in addition to amino groups as discussed, carboxy, hydroxy, epoxy, isocyanate, thioether, and mercapto functional groups, while nonfunctional polyorganosiloxanes are polyorganosiloxanes without groups of this type.

The nonfunctional polyorganosiloxanes, including nonfunctional polydimethylsiloxanes, preferably have a viscosity of from about 200 centistokes to about 100,000 centistokes. More preferably they have a viscosity of from about 350 centistokes to about 60,000 centistokes.

Where the release agent comprises both aminofunctional and nonfunctional polyorganosiloxane, preferably it comprises from about ½ percent by weight to about 80 percent by weight—more preferably from about 2 percent by weight to about 80 percent by weight, still more preferably from about 4 percent by weight to about 20 percent by weight, and yet more preferably about 4.4 percent by weight or about 12.5 percent by weight—aminofunctional polyorganosiloxane. Also as a matter of preference, the release agent comprising both aminofunctional and nonfunctional polyorganosiloxane has a viscosity of from about 150 centistokes to about 200,000 centistokes, more preferably from about 250 centistokes to about 60,000 centistokes, still more preferably from about 1,000 centistokes to about 6,000 centistokes or to about 60,000 centistokes, and yet further preferably from about 5,000 centistokes to about 60,000 centistokes.

In the release agent composition comprising aminofunctional and nonfunctional polyorganosiloxanes, preferred nonfunctional polyorganosiloxanes are the nonfunctional polydimethylsiloxanes, and preferred aminofunctional polyorganosiloxanes are the monoaminofunctional polyorganosiloxanes, particularly the monoaminofunctional polydimethylsiloxanes. Particularly preferred of these indicated monoaminofunctional polymers are those that are amino group terminated.

Preferably the release agent composition comprises a nonfunctional polydimethylsiloxane and a monoaminofunctional polydimethylsiloxane that is amino group terminated. Preferably, the nonfunctional polydimethylsiloxane has a viscosity of from about 200 centistokes to about 80,000 centistokes, more preferably from about 1000 centistokes to about 60,000 centistokes. The amino group terminated monoaminofunctional polydimethylsiloxane preferably has a number average molecular weight of from about 10,000 to about 14,000—more preferably, of about 12,000. Also as a matter of preference the amino group terminated monoaminofunctional polydimethylsiloxane is terminated at one end with a 3-aminopropylamino group, and at the other end with a trimethyl siloxy group. In a particularly preferred embodiment, this release agent comprises 12.5 percent, or about 12.5 percent, by weight of the amino group terminated monoaminofunctional polydimethylsiloxane, and 87.5 percent, or about 87.5 percent, by weight of the nonfunctional polydimethylsiloxane.

Along with or instead of one or more nonfunctional polyorganosiloxanes, the release agent can include, together with the one or more aminofunctional polyorganosiloxanes, one or more additional functional polyorganosiloxanes, such as carboxy, hydroxy, epoxy, amino, isocyanate, thioether, and mercapto functional polyorganosiloxanes. Of these, the mercaptofunctional polyorganosiloxanes are preferred.

Preferred mercaptofunctional polyorganosiloxanes include monomercaptofunctional polyorganosiloxanes. Among the suitable monomercaptofunctional polyorganosiloxanes are those wherein the sole mercapto group is a side group; however, the preferred monoaminofunctional polyorganosiloxanes are those that are mercapto group terminated.

The mercaptofunctional polyorganosiloxanes preferably have a number average molecular weight of from about 4,000 to about 150,000. More preferably they have a number average molecular weight of from about 8,000 to about 120,000.

Mercaptofunctional polyorganosiloxanes preferably comprise as great a molar proportion of monomercaptofunctional polyorganosiloxanes as is practically possible. As with aminofunctional polyorganosiloxanes, the most preferred mercaptofunctional polyorganosiloxanes are those which are exclusively monofunctional, or at least consist essentially of, or consist substantially of, monomercaptofunctional polyorganosiloxanes, while for practical considerations, as a matter of preference the mercaptofunctional polyorganosiloxanes are predominantly monomercaptofunctional polyorganosiloxanes, or at least comprise a majority of monomercaptofunctional polyorganosiloxanes, as a molar proportion.

The release agent disclosed herein is also suitable for the toner fusing system and process of the application Ser. No. 09/879,585, and for the toner fusing system and process of the application Ser. No. 09/879,466.

As to the significance of functionality, and particularly amino functionality, with respect to release agents, the silicone chain in and of itself has a very low surface energy. Silicone wets many materials, but it generally does not form a strong attachment, and is therefore vulnerable to displacement. With release agents, specifically in the case of nonfunctional polyorganosiloxanes, and particularly nonfunctional polydimethylsiloxanes, where toner contacts a fuser member treated with these it more easily displaces them, thereby coming into direct contact with the surface itself. Undesirable toner offset, and diminishment of release properties, can accordingly result.

The use of release agents having functional groups, or functional release agents, including those comprising functional polyorganosiloxanes, can result in greater beneficial effects—e.g., toner offset resistance and release properties—with fusing surface layers incorporating certain fillers. It is believed that this enhanced performance occurs because the interaction between release agent and fusing surface layer is greater due to the presence of functional group and filler, although it is not known if the increased interaction is solely between functional group and filler agent, or whether one or more other portions of the release agent, and/or other material in the layer, also contribute to this effect. In any event, the stronger interaction apparently renders functional polyorganosiloxanes more difficult to displace, while more easily and quickly reassuming contact if displacement does occur.

$Fe_2O_3$, SnO2, SiC, and $Al_2O_3$ all are among a multiplicity of fillers with high particle surface energies, and correspondingly, as discussed herein, there are release agents with a variety of functional groups. There was no reason to expect that, of all the high energy fillers, $Fe_2O_3$ would result in greater improvement to fusing surface layer offset resistance and release effect than the other fillers, or that this result would be obtained particularly with release agents having aminofunctional polyorganosiloxanes.

Nevertheless, it has been discovered that such enhanced performance indeed is provided by utilizing fusing surface layers with $Fe_2O_3$ filler, together with aminofunctional polyorganosiloxane release agents. Further, it is believed that this is caused by an unexpectedly high degree of interaction between release agent and surface fusing layer—i.e., greater than would have been expected merely due to the presence of functional group and high energy filler.

This unexpectedly high interaction, between aminofunctional polyorganosiloxane and $Fe_2O_3$-bearing fusing surface layer, suggests an additional effect enhancing the thickness of the protective layer formed by the release agent. In fact, protective layer thickness is a function of at least two factors: (1) the number of polymer chains which are attaching, and (2) the polymer chains' length.

Because the aminofunctional group is strongly interacting, more polymer chains of a given length can be accommodated within the available layer space. The result is a thicker protective layer.

Here also monofunctionality provides added benefit. With a polymer chain having only one functional site for the fusing surface layer, less of the chain is impelled to interact with the layer, and each chain accordingly takes up less of the layer space. And particularly in the case of amino termination for the monoaminofunctional polymer, the location of the sole functionality at chain's end means that still a smaller chain portion utilizes space on the layer surface. Accordingly, monofunctionality increases chain density on the fusing surface layer, and amino terminating monofunctionality provides that still more polymer can be accommodated.

In any event, the additional effect as indicated, and the resulting thickness enhancement, may be due to catalytic activity of $Fe_2O_3$ with aminofunctional polysiloxane. A. W. Henry, "High Temperature Degradation of Silicone Rubber Compounds in a Silicone Oil Environment", *Rubber Chemistry and Technology*, Vol. 56, pp. 83–92 (1982), incorporated herein in its entirety by reference thereto, discusses the use of $Fe_2O_3$ for heat stabilization of silicone elastomers. Therein it is stated that iron oxide is known to prevent oxidative coupling via siloxane chain side methyl groups, and that iron oxide is thought to act as a catalyst of siloxane rearrangement reactions.

This activity could help to increase the amount of aminofunctional polysiloxane attaching to the layer surface. Specifically, in the vicinity of the metal oxide surface, where the concentration of acidic or basic functional groups would be increased, the $Fe_2O_3$ activity may lead to a thin renewable surface crosslinked network, with this increased release agent interaction providing greater performance—for instance, with respect to toner offset resistance and release properties—as discussed.

Notwithstanding the low surface energy of the polyorganosiloxanes, as discussed, preferably the release agent comprises both aminofunctional and nonfunctional polyorganosiloxane, also as discussed. One purpose served by nonfunctional polyorganosiloxane is as a diluent for the functional compound, so as to lessen the expense of the release agent. However, the nonfunctional component also serves a useful function with regard to establishment of the protective layer.

Specifically, while nonfunctional polyorganosiloxane indeed does wet the fusing surface layer, in accordance with the discussion herein, the attachment is not strong, also as noted; highly fluorinated, low surface energy materials, such as the fluoroelastomer of this layer, are not easily wet by silicone fluids. A much stronger interaction occurs between aminofunctional polyorganosiloxane and this layer's surface, and it is accordingly the aminofunctional component that preferentially effects wetting. In doing so, the aminofunctional polyorganosiloxane presents a silicone moiety, which the nonfunctional polyorganosiloxane, due to identity of structure, will advantageously wet. So because of the presence of aminofunctional polyorganosiloxane, the nonfunctional polyorganosiloxane component makes a more effective contibution to the intended functions of the release agent—e.g., resisting toner offset and enhancing release properties.

With respect to attachment, interaction, and layer thickness enhancing effect, as these have been discussed, their nature is not fully understood. It is not known to what extent, if any, any of them involves, for instance, chemical reaction, coordination complex, hydrogen bonding, ionic attraction, or some other mechanism. They are addressed herein for the purpose of discussing the invention as fully as possible according to the best current understanding thereof, and this attempt is not to be considered as limiting the scope of the invention.

The release agent may be applied to the fuser member by any suitable applicator, including sump and delivery roller, jet sprayer, etc. Those means as disclosed in U.S. Pat. Nos. 5,017,432 and 4,257,699 may be employed; these two patents are incorporated herein in their entireties, by reference thereto. Preferably the present invention employs a rotating wick oiler or a donor roller oiler.

A rotating wick oiler comprises a storage compartment for the release agent and a wick for extending into this compartment. During operation of the toner fusing system of the invention, the wick is situated so as to be in contact with the stored release agent and also with the fusing surface layer of the fuser member; the wick thusly picks up release agent and transfers it to the fuser member.

A donor roller oiler includes two rollers and metering blade, which can be a rubber, plastic, or metal blade. One roller meters the oil in conjunction with the blade, and the other transfers the oil to the fuser roller. This type of oiler is common in the art, and is frequently used with fuser members having fluoroelastomer fusing surface layers.

The release agent is applied to the substrate, particularly in the case of paper, preferably at a rate of from about 0.1 to about 20 microliters, more preferably at a rate of about 1.0 to about 8 microliters, per 8½" by 11" copy. The applicator accordingly is adjusted to apply the release agent at this rate.

The fuser base and the support member, the cushion between fuser base and fusing surface layer, if employed, and the cushion and/or surface layer mounted on the support member, also if employed, may be those as are known in the art, as well as those particularly disclosed in the application Ser. No. 09/879,585 Internal heating and/or external heating may be employed. Likewise the heating means as are known in the art, including conventional external and internal heating means, are suitable, as are the particular external and internal heating members as disclosed in the indicated application.

Preferably the fuser base is in the form of a cylindrical roller, with the fuser member correspondingly in the form of a roller—specifically, a fuser roller. Also as a matter of preference, the support member comprises a backup roller.

A toner fusing system of the invention is shown in FIG. 1. Multilayered fuser roller 10 comprises, in sequential order, a fuser base 11, in the form of a hollow cylindrical roller, as well as a cushion layer 12 and a fusing surface layer 13. Fusing surface layer 13 has $Fe_2O_3$ filler particles (not depicted in FIG. 1) dispersed therein. Internal heating member 14, an optional element in the invention, is disposed in the hollow portion of fuser base 11.

External heating members 15 and 16 are in the form of hollow cylindrical rollers; their rotational directions, and the rotational directions of all the other rotating elements, are shown by their respective arrows. The rotational directions as depicted can all be reversed.

External heating members 15 and 16 are heated by respective heating lamps 17. These two contact heating members are spaced apart by a distance less than the diameter of fuser member 10, which is in contact with both. Contact heating members 15 and 16 transfer heat to fuser member 10 by their contact with fusing surface layer 13.

Rotating wick oiler 18 applies release agent to fusing surface layer 13.

Support member 19, in the form of a backup roller, cooperates with fuser member 10 to form fusing nip or contact arc 20. Copy paper or other substrate 21, carrying unfused toner images 22, passes through fusing nip 20 so that toner images 22 are contacted by fusing surface layer 13. Support member 19 and fuser member 10 act together to apply pressure to the paper 21 and toner 22, and fuser member 10 also provides heat, with the heat and pressure serving to fuse toner 22 to the paper 21.

Dispensing roller 26 incrementally feeds cleaning web 24 over advance roller 25, to be rolled up onto collecting roller 23. In passing along roller 25, web 24 contacts and cleans contact heating members 15 and 16.

Cleaning web 24 is a polyamide material. A polyamide web which may be employed for this purpose is commercially available under the trademark Nomex® from BMP of America, Medina, N.Y. Any other suitable cleaning material may be employed instead.

In place of the indicated cleaning assembly, any other means or apparatus appropriate for cleaning the contact heating members may be employed. Alternatively, the contact heating members can be provided with a nonstick coating. This coating can be a fluoroplastic, as discussed herein, and it can include a heat conducting filler, also as discussed herein. Where the contact heating members have a nonstick coating the means for cleaning these members can be omitted.

FIG. 2 shows a fragmentary view of an embodiment of fuser member 10, magnified to show the multiple layers in greater detail. Heat conducting $Fe_2O_3$ filler particles 27 are distributed through fusing surface layer 13.

Figure 3:
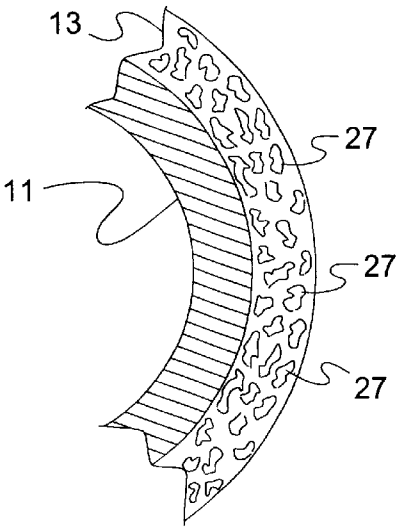
FIG. 3 is a schematic representation, and an enlarged fragmentary sectional view, of another embodiment of the fuser member of the invention.

FIG. 3 shows a fragmentary view of another embodiment of fuser member 10, also magnified to show greater detail. In this embodiment there is no cushion, and fusing surface layer 13 resides directly on fuser base 11.

The invention is illustrated by the following procedures; these are provided for the purpose of representation, and are not to be construed as limiting the scope of the invention. Unless stated otherwise, all percentages, parts, etc. are by weight.

EXPERIMENTAL PROCEDURES

Materials Employed in the Procedures

Fluorel™ FLS5840Q fluoroelastomer, a terpolymer of vinylidene fluoride, hexafluoropropylene, and tetrafluoroethylene Viton® A fluoroelastomer, a copolymer of vinylidene fluoride and hexafluoropropylene Viton® GF fluoroelastomer, a terpolymer of vinylidene fluoride, hexafluoropropylene, and tetrafluoroethylene Viton® GFLT fluoroelastomer, a terpolymer of vinylidene fluoride, perfluorovinylmethylether, and tetrafluoro-ethylene Tin, iron, and aluminum metal foils, from Aldrich® Chemical, Milwaukee, Wis.

Pyrolitic graphite slab, from Advanced Ceramics Corporation, Cleveland, Ohio.

Silicon carbide o-ring, from Alumina Ceramics Inc., Bristol, Ak.

$Fe_2O_3$ 0.7 and 0.27 microns mean particle diameters, from Harcros Pigments Inc.

Hexamethyldisilazane surface-treated fumed $SiO_2$, having a surface area of approximately 212+/−28$m^2$ per gram and a particle size greater than 0.2 microns (Cab-O-Sil® TS-530), from Cabot Corporation, Tuscola, Ill.

FeO(OH), from Harcros Pigments Inc.

$Al_2O_3$ (Al600), approx. 1 micron mean particle diameter, from Atlantic Equipment Engineers, Bergenfield, N.J.

SiC (SIKAIII, F1000), from Washington Mills, Niagara Falls, N.Y.

$SnO_2$ (CS3), from Magnesium Electron, Inc., Flemington, N.J.

MgO (Maglite™ -Y), from Merck/Calgon Corp., Teterboro, N.J.

3-aminopropyltriethoxysilane, from Gelest, Inc., Tulleytown, Pa.

Cylindrical ceramic media, from US Stoneware, East Palestine, Pa.

PS513 bis (aminopropyl) terminated polydimethylsiloxane wetting agent, from United. Chemical Technologies, Inc., Bristol, Pa.

Xerox Fusing Agent II blend, comprising about 12.5 percent by weight of an essentially monofunctional N-propyl-aminofunctional polydimethylsiloxane with a number average molecular weight of about 12,000, and about 87.5 percent by weight blend nonfunctional polydimethylsiloxane with a number average molecular weight of about 12,000, from Xerox Corp., Stamford, Conn.

1,000 centistoke DC200 polydimethylsiloxane, from Dow Corning Corporation, Midland, Mich.

Viton® Curative No. 50

Catalyst 50, from Emerson & Cuming ICI, Billerica, Mass.

Varox DBPH 50 peroxide curative, from R. T. Vanderbilt Company Inc., Norwalk, Conn.

Triallyl cyanurate crosslinking agent, from Aldrich® Chemical.

Interaction of Aminofunctional and NonFunctional Release Fluids with Selected Surfaces An aminofunctional polydimethylsiloxane/polydimethylsiloxane blend, and a polydimethylsiloxane, were used to treat several surfaces. For each release fluid, the molecular interaction with the different surfaces was evaluated by treating a surface with the fluid, and measuring the amount of fluid remaining attached to the surface. The surfaces were provided in the following manner.

Silicon carbide was cleaved from a solid direct sintered silicon carbide o-ring, graphite was obtained as a monolithic Pyrolitic Graphite slab, and both were cleaned with dichloromethane(DCM). Pure metal foils of tin, iron, and aluminum also were cleaned with DCM, with the iron foil receiving a KOH treatment to remove an existing rust prevention silicone layer. The thusly prepared metal foils were treated with an oxygen plasma for 1 minute to obtain clean oxide surface layers.

The surfaces provided as indicated were measured for silicon contamination using X-ray photoelectron spectroscopy (XPS). The amount of silicon was determined and is shown in Table 1 as the percentage of measured surface atoms which are silicon.

As can be seen from Table 1, the surfaces all show less than 4 atomic percent silicone after cleaning. It is noted that in analysis of the XPS spectra, the silicon in the silicon carbide can be distinguished from SiOx silicon, such as is found in silicone materials, by a significant shift in the peak location.

Sample surfaces were then treated with an excess of nonfunctional polydimethylsiloxane (DC200), or with aminofunctional polydimethylsiloxane/nonfunctional polydimethylsiloxane blend (Xerox Fusing Agent II), for 1 hour and 15 minutes at 175° C. The samples were removed, cooled, and cleaned with DCM. After drying, the samples were measured, again using XPS, for attachment of the silicone fluid by determining the increase in silicon signal from the attached silicone chains. The atomic percentage silicon after treatment, according to this measurement, also is shown in Table 1.

The XPS measurements were performed on a 5600 ESCA system, from Physical Electronics Inc., Eden Prairie, Minn. The peak fitting assignments were based on the *Handbook of X-ray Photoelectron Spectroscopy*, J. Chastain, Editor, published by Perkin-Elmer Corporation, Copyright 1992.

TABLE 1

| | | Atomic % Silicon* | | |
|---|---|---|---|---|
| | | | After treatment with: | |
| | Surface | After Cleaning | Non-Functional Fluid | Amine Functional Fluid |
| Ex1 | Fe2O3 | 3.24 | 9.7 | 25.58 |
| CE1 | SiC | 0.8–2 | 17.3 | 15.6 |
| CE2 | SnO2 | 1.33 | 9.4 | 14.0 |
| CE3 | Al2O3 | ND** | 6.68 | 11 |
| repeat | | | | 10.48 |
| CE4 | Graphite | ND** | 3.1 | 13.84 |

*Distinct from SiC and SiOH silicon species.
**NO detection

The foregoing results demonstrate the inherent superior interaction of iron(III) oxide with amine functional oils. Specifically, they show that iron(III) oxide exhibits the greatest affinity for the amine functional release agents, and provides the thickest protective layer. Silicon carbide and stannic oxide show improved interaction with silicone release fluids compared to aluminum oxide. Graphite shows little interaction with the nonfunctional oil, as would be expected for the nonpolar material.

Preparation of Fuser Members

The fuser rollers of Examples 2–9 and Comparative Examples 5–11 were prepared in accordance with the information set forth in Table 2 and subsequently.

TABLE 2

Fusing Surface Layer Composition Components and Solution Viscosities for Preparing Fuser Members

| | Filler | Particle Size | Volume % Filler | | Viscosity (cp) |
|---|---|---|---|---|---|
| Ex 2 | Fe2O3 | 0.7 um | 35 | Viton ® A | 180 |
| Ex 3 | Fe2O3 | 0.7 um | 25 | Viton ® A | 172 |
| Ex 4 | Fe2O3 | 0.27 um | 35 | Viton ® A | 180 |
| Ex 5 | Fe2O3 | 0.7 um | 35 | Viton ® GF | 196 |
| Ex 6 | Fe2O3 | 0.7 um | 35 | FLS5840Q | 200 |
| Ex 7 | Fe2O3 | 0.7 um | 35 | Viton ® GFLT | 272 |
| Ex 8 | Fe2O3/Fumed Silica | 0.7 um/ >0.2 um | 25/ 8.5 | Viton ® A | 165 |
| Ex 9 | Fe2O3/Fumed Silica | 0.7 um/ >0.2 um | 20/ 16 | Viton ® A | 175 |
| CE 5 | FeO(OH) | 0.5 um | 35 | Viton ® A | n.a. |
| CE 6 | FeO(OH) | 1.5 um | 35 | Viton ® A | n.a. |
| CE 7 | Al2O3 (treated) | 1.0 um | 35 | Viton ® A | 132 |
| CE 8 | Al2O3 | 1.0 um | 35 | Viton ® A | 155 |
| CE 9 | SnO2 | >8 um | 35 | Viton ® A | 72.5 |
| CE 10 | SiC | >4 um | 35 | Viton ® A | 107.5 |
| CE 11 | Fumed Silica | >0.2 um | 30 | Viton ® A | 91 |

Example 2

300 grams of Viton® was mixed with 498 grams of iron(III) oxide and 36 grams of MgO. The formulation was compounded on a water cooled two roll mill at 63° F. (17° C.) until a uniform, dry composite sheet was obtained. The sheet was removed and stored until used for the preparation of a coating solution.

A portion of the milled composition was dissolved in MEK, using the necessary amounts of each for forming 89.2 grams of a 40 weight percent solution, and the solution was mixed in a jar overnight. Solution viscosity was adjusted to 180 centipoise with MEK, and 0.974 grams of Viton® Curative No. 50 (2.73 parts per 100 parts by weight milled composition) was added 30 minutes prior to coating, and PS513 was also added at this time (0.45 parts per 100 parts by weight solution).

The resulting curable solution was ring coated twice onto a cylindrical roller, in the form of a 40 shore A 0.4" base cushion on an aluminum core. After air drying, the thusly roller was baked by ramping from room temperature to 230° C. over 12 hours and then holding at 230° C. for 24 hours. The resulting fuser roller had a fluorocarbon polymer outer layer with a thickness of about 38 microns.

Example 3

A fuser roller was prepared in substantially the same manner as that of Example 2, except that only 306 grams of iron(III) oxide was used in preparing the fluoroelastomer composition, and 3.17 parts of the curative per 100 parts by weight of the milled composition were employed in preparing the curable solution.

Example 4

A fuser roller was prepared in substantially the same manner as that of Example 2, except the iron(III) oxide which was used had particle size of 0.27 microns rather than 0.7 microns, 3.0 parts of the curative per 100 parts by weight of the milled composition were employed in preparing the curable solution, and the solution was dissolved in a ceramic crock containing cylindrical ceramic media.

Example 5

A fuser roller was prepared in substantially the same manner as that of Example 2, except the fluoroelastomer used was Viton® GF.

Example 6

A fuser roller was prepared in substantially the same manner as that of Example 2, except the fluoroelastomer used was FLS5840Q, and the amount of MgO used was increased to 15 parts per 100 parts by weight of fluoroelastomer.

Example 7

A fuser roller was prepared in substantially the same manner as that of Example 2, except 3 parts Varox DBPH50 and 1.5 parts triallyl cyanurate per 100 grams of fluoroelastomer were used in place of the Viton® Curative No. 50, and the amount of MgO used was only 5 parts per 100 parts by weight of fluoroelastomer.

Example 8

A fuser roller was prepared in substantially the same manner as that of Example 4, except that in place of the 498 grams of 0.27 microns iron(III) oxide, 49.5 grams of hexamethyldisilazane surface-treated fumed $SiO_2$ and 357 grams of 0.7 microns iron(III) oxide were both used, and 2.3 parts of the curative per 100 parts by weight of the milled composition were employed in preparing the curable solution.

Example 9

A fuser roller was prepared in substantially the same manner as that of Example 8, except that 97.8 grams of the hexamethyldisilazane surface-treated fumed silica and 285 grams of the 0.7 microns iron(III) oxide were used, and 2.92 parts of the curative per 100 parts by weight of the milled composition were employed in preparing the curable solution.

Comparative Examples 5 and 6

In each of these Comparative Examples, the procedure for preparing coating solution was the same as that used for Example 2, except that in place of 0.7 micron ferric oxide, 0.5 micron FeO(OH) was used in Comparative Example 5 and 1.5 micron FeO(OH) was used in Comparative Example 6, and in both Comparative Example 5 and Comparative Example 6, 2.5 parts of the curative per 100 parts by weight of the milled composition were employed in preparing the curable solution.

In both Comparative Examples the composition failed to dissolve, producing a grainy solution. It is likely that the water in the hydrated iron oxide interferes with the dissolution of the composition and accelerates gellation when used at high levels.

Comparative Example 7

A fuser roller was prepared in substantially the same manner as that of Example 2, except that 375 grams of $Al_2O_3$, having a particle size of about 1 micron, were used in place of the 498 grams of 0.7 microns mean particle diameter iron(III) oxide, during milling 0.3 grams of aminopropyl triethoxysilane was added to the composition, and 2.73 parts of the curative per 100 parts by weight of the milled composition were employed in preparing the curable solution. Additionally, the solution had to be prepared twice, because the pot life was too short to allow both coatings.

Comparative Example 8

A fuser roller was prepared in substantially the same manner as that of Comparative Example 7, except the aminopropyl triethoxysilane surface treatment was omitted, and 2.9 parts of the curative per 100 parts by weight of the milled composition were employed in preparing the curable solution. Without the aminopropyl triethoxysilane surface treatment the solution still demonstrated a very short pot life (less than 2 hours).

Comparative Example 9

A fuser roller was prepared in substantially the same manner as that of Example 2, except that 660 grams of $SnO_2$, having a particle size greater than 8 microns, were used in place of the 498 grams of 0.7 microns particle size iron(III) oxide, and 2.08 parts of the curative per 100 parts by weight of the milled composition were employed in preparing the curable solution. The solution exhibited a short pot life (less than 6 hours).

Comparative Example 10

A fuser roller was prepared in substantially the same manner as that of Example 2, except that 306 grams of SiC, having a particle size greater than 4 microns, were used in place of the 498 grams of 0.7 microns particle size iron (III) oxide, and 3.22 parts of the curative per 100 parts by weight of the milled composition were employed in preparing the curable solution.

Comparative Example 11

A fuser roller was prepared in substantially the same manner as that of Example 4, except that 98.4 grams of hexamethyldisilazane surface-treated fumed silica were used in place of the 498 grams of 0.27 microns iron(III) oxide, 2.64 parts of the curative per 100 parts by weight of the milled composition were employed in preparing the curable solution, and the curable solution was allowed to mix in a jar overnight prior to coating.

Determination of Length of Pot Life

Example 10

Three different solutions were prepared from portions of the Example 2 milled composition. These solutions included the same 12 grams of the composition and 20 grams of MEK, but different amounts of Viton® Curative No. 50—specifically, 0.204 grams (1.7 pph composition), 0.264 grams (2.2 pph composition), and 0.336 grams (2.8 pph composition).

A fourth solution was prepared using the milled composition of Comparative Example 7. This solution was made in the same manner as the curable solution of Comparative Example 7, except that 2.5 parts of the curative per 100 parts by weight of the milled composition were employed.

These four solutions, and portions of the solutions of Comparative Examples 5, 6, 8, 9, were measured for viscosity. In each instance the solution was allowed to mix in a sealed jar, while periodic viscosity measurements were taken. These measurements are shown in Table 3.

The data set forth here demonstrate the excellent processability of the iron(III) oxide, in contrast to that of the other fillers at small particle size, and contrary to the use of yellow iron oxide in significant amounts. As can be seen in Table 3, all three of the Example 2 solutions exhibited excellent pot life, with the viscosity remaining coatable for more than 7 hours in each instance. Solutions of Comparative Examples 7 and 8 gelled within 30 minutes, requiring a new solution to be prepared for coating a second layer, and Comparative Examples 5 and 6 failed to dissolve uniformly. Comparative Example 9 also was determined to have a relatively short pot life.

TABLE 3

Measurements Pertaining to Viscosity Determination

| | Curative Level (pph composition) | Viscosity (cp) at Addition of Cure | Time until Viscosity Exceeds 500 cp |
|---|---|---|---|
| Ex2 | 1.7 | 85–95 | >7 hours |
| | 2.2 | | |
| | 2.8 | | |
| CE5 | 2.5 | n.a.* | n.a.* |
| CE6 | 2.5 | n.a.* | n.a.* |
| CE7 | 2.5 | 120–150 | <1 hr |
| CE8 | 2.9 | 155 | <1 hr |
| CE9 | 2.08 | 73 | 3–5 hrs |

*Failed to dissolve.

Determination of Wear Resistance

Coatings from the fuser rollers of Examples 2–4, 8, and 9, and Comparative Examples 8–10, were subjected to wear testing. Wear was measured using a modified Norman Abrasion Wear Tester, from Norman Tool Inc., Evansville, Ind. In each instance a sample was cut from the coated roller, and trimmed to a width of 0.59 inches and a thickness of about 0.04 inches. The sample was placed on a heated stage and worn with 11/16" Norman wear test paper using a 755 gram load. The wear rate was determined by measuring the worn groove depth (without penetration of the coated layer) for a given number of wear cycles, and calculating the wear rate in microns per 100 cycles.

As seen from Table 4, the wear characteristics as determined by this procedure ranged from acceptable to excellent.

TABLE 4

Measurements Concerning Wear Rate of Coatings

| Coating | Filler(s) | Cure Level (pph compound) | Wear Depth (microns per 100 cycles) |
|---|---|---|---|
| Ex2 | Fe2O3 | 2.73 | 47.24 |
| Ex3 | Fe2O3 | 3.17 | 12.95 |
| Ex4 | Fe2O3 | 3.0 | 12.2 |
| Ex8 | Fe2O3/Fumed Silica | 2.3 | 12.2 |
| Ex9 | Fe2O3/Fumed Silica | 2.92 | 7.62 |
| CE8 | Al2O3 | 2.9 | 41.9 |
| CE9 | SnO2 | 2.08 | 80 |
| CE10 | SiC | 3.22 | 28.7 |

Determination of Toner Release

Example 11

A fuser roller was prepared in substantially the same manner as that of Example 8, except that in preparing the coating solution, 1.2 parts of the curative per 100 parts by weight of the milled composition were employed.

The fuser rollers of Examples 2 and 11, and Comparative Examples 8 and 11, were further used to test the toner release resistance. The test samples were ⅓-inch squares cut from each coated roller. These samples were employed to evaluate the toner release force characteristics of the respective fuser member coatings. They were wiped with aminofunctional polydimethylsiloxane oil (α-aminopropyl, ω-trimethyl terminated polydimethylsiloxane with a number average molecular weight of about 12,000, and an amine functionality of about one per siloxane chain). The excess oil was removed with a tissue.

Each sample was tested in the following manner. A half-inch square of paper covered with 0.8 reflection density unfused polystyrene-co-butylacrylate toner was placed in contact with the oiled sample, and removed to leave 90–95% of the toner on the sample surface. The toned sample was placed on a bed heated to 175° C., with the toned side facing up. The circular face of a ⅛ inch diameter stainless steel probe was placed in contact with the toned surface under a compressive load of 200 grams. After 20 minutes the disk was slowly raised and the peak release force measured.

Peak release force measurements determined from the foregoing procedure are shown in Table 5. Lower release force values indicate better release.

TABLE 5

Toner Release Testing

| Coating | | Cure Level (pph) | Viscosity (cp) | Release Force of Aminofunctional Oil Treated Samples (g) #1 | #2 |
|---|---|---|---|---|---|
| Ex2 | Fe2O3 | 2.73 | 136 | 1.0 | 3.5 |
| CE7 | Al2O3 | 2.73 | 132 | 2.0 | 7.0 |
| CE11 | Fumed Silica | 2.64 | 91 | 8.0 | 17 |
| Ex11 | Fe2O3/ Fumed silica | 1.2 | 107 | 4.5 | 12 |

The results stated in Table 5 show the fusing surface layer incorporating iron(III) oxide to have superior release compared to that with aluminum oxide, even with the aluminum oxide having been surface treated, while the iron (III) oxide was not. A comparison of the Example 11 peak release force values with those of Comparative Example 11 demonstrate that iron (III) oxide, used in combination with other fillers, improves their release performance.

Finally, although the invention has been described with reference to particular means, materials, and embodiments, it should be noted that the invention is not limited to the particulars disclosed, and extends to all equivalents within the scope of the claims.

What is claimed is:

1. A process for fusing toner residing on a substrate to the substrate, the process comprising:

(a) applying a release agent comprising an aminofunctional polyorganosiloxane to the fusing surface layer of a fuser member to provide a release agent-treated fusing surface layer, the fuser member comprising:

(1) a fuser base;

(2) the fusing surface layer, comprising:

(A) at least one fluoroelastomer, and (B) $Fe2O_3$ filler particles; and (b) contacting the toner with the release agent-treated fusing surface layer.

2. The process of claim 1, wherein the $Fe_2O_3$ filler particles have a mean particle diameter of from about 0.1 microns to about 20 microns.

3. The process of claim 2, wherein the $Fe2O_3$ filler particles comprise from about 10 percent by volume to about 35 percent by volume of the fusing surface layer.

4. The process of claim 1, wherein the $Fe_2O_3$ filler particles comprise $Fe_2O_3$ filler particles having a mean particle diameter of from about 0.1 microns to about 2.0 microns, and $Fe_2O_3$ filler particles having a mean particle diameter of from about 5.0 microns to about 10.0 microns.

5. The process of claim 4, wherein the $Fe_2O_3$ filler particles comprise from about 10 percent by volume to about 35 percent by volume of the fusing surface layer, with the $Fe_2O_3$ filler particles having a mean particle diameter of from about 0.1 microns to about 2.0 microns comprising from about 10 percent by volume to about 35 percent by volume of the fusing surface layer, and the $Fe_2O_3$ filler particles having a mean particle diameter of from about 5.0 microns to about 10.0 microns comprising essentially the remainder of the $Fe2O_3$ filler particles.

6. The process of claim 4, wherein at least for the $Fe_2O_3$ filler particles having a mean particle diameter of from about 0.1 microns to about 2.0 microns, the $Fe_2O_3$ comprises $Fe_2O_3$ prepared from at least one sulfur-containing iron compound.

7. The process of claim 1, wherein the $Fe2O_3$ comprises $Fe_2O_3$ prepared from at least one sulfur-containing iron compound.

8. The process of claim 7, wherein the $Fe_2O_3$ filler particles have a mean particle diameter of from about 0.1 microns to about 20 microns.

9. The process of claim 8, wherein the $Fe_2O_3$ filler particles have a mean particle diameter of from about 0.2 microns to about 12 microns.

10. The process of claim 9, wherein the $Fe_2O_3$ filler particles comprise from about 10 percent by volume to about 35 percent by volume of the fusing surface layer.

11. The process of claim 1, wherein the $Fe2O_3$ comprises silane coupling agent-treated $Fe_2O_3$.

12. The process of claim 1, wherein the aminofunctional polyorganosiloxane comprises a monoaminofunctional polyorganosiloxane.

13. The process of claim 12, wherein the aminofunctional polyorganosiloxane comprises more than 50 mole percent monoaminofunctional polyorganosiloxane.

14. The process of claim 12, wherein the monoaminofunctional polyorganosiloxane comprises an aminoterminated monoaminofunctional polyorganosiloxane.

15. The process of claim 14, wherein the aminofunctional polyorganosiloxane comprises more than 50 mole percent amino group terminated monoaminofunctional polyorganosiloxane.

16. The process of claim 14, wherein the aminoterminated monoaminofunctional polyorganosiloxane comprises an amino-alkylterminated monoaminofunctional polydimethylsiloxane having a number average molecular weight of from about 10,000 to about 14,000.

17. The process of claim 16, wherein the aminoalkylterminated monoaminofunctional polydimethylsiloxane comprises an aminopropylterminated monoaminofunctional polydimethylsiloxane.

18. The process of claim 1, wherein the release agent further comprises a nonfunctional polyorganosiloxane.

19. The process of claim 18, wherein the aminofunctional polyorganosiloxane comprises a monoaminofunctional polyorganosiloxane.

20. The process of claim 19, wherein the aminofunctional polyorganosiloxane comprises more than 50 mole percent monoaminofunctional polyorganosiloxane.

21. The process of claim 19, wherein the monoaminofunctional polyorganosiloxane comprises an aminoterminated monoaminofunctional polyorganosiloxane.

22. The process of claim 21, wherein the aminofunctional polyorganosiloxane comprises more than 50 mole percent aminoterminated monoaminofunctional polyorganosiloxane.

23. The process of claim 18, wherein the nonfunctional polyorganosiloxane comprises a nonfunctional polydimethylsiloxane having a viscosity of from about 200 centistokes to about 80,000 centistokes.

24. The process of claim 23, wherein the aminofunctional polyorganosiloxane comprises an aminoalkylterminated monoaminofunctional polydimethylsiloxane having a number average molecular weight of from about 10,000 to about 14,000.

25. The process of claim 24, wherein the aminoalkylterminated monoaminofunctional polydimethylsiloxane comprises an aminopropylterminated monoaminofunctional polydimethylsiloxane.

26. The process of claim 24, wherein the aminoalkylterminated monoaminofunctional polydimethylsiloxane comprises from about 4 weight percent to about 20 weight percent of the release agent.

27. The process of claim 24, wherein the fluoroelastomer comprises the monomeric units $$-(CH_2CF_2)_x-,\ -(CF_2CF(CF_3))_y-,\ \text{and}\ -(CF_2CF_2)_z-,$$

wherein x is from about 30 to about 90 mole percent, y is from about 10 to about 60 mole percent, and z is from about 0 to about 42 mole percent.

28. The process of claim 24, wherein the fluoroelastomer comprises the monomeric units $$-(CH_2CH_2)_x-,\ -(CF_2CF(OCF_3))_y-,\ \text{and}\ -(CF_2CF_2)_z-,$$

wherein x is from about 0 to about 70 mole percent, y is from about 10 to about 60 mole percent, and z is from about 30 to about 90 mole percent.

29. A fuser member, for a toner fusing system or process, comprising:

(a) a base; and (b) a fusing surface layer comprising:

(i) at least one fluoroelastomer; and (ii) $Fe_2O_3$ filler particles, wherein the $Fe_2O_3$ comprises $Fe_2O_3$ prepared from at least one sulfur-containing iron compound.

30. The fuser member of claim 29, wherein the $Fe2O_3$ filler particles have a mean particle diameter of from about 0.1 microns to about 20 microns.

31. The fuser member of claim 30, wherein the $Fe_2O_3$ filler particles have a mean particle diameter of from about 0.2 microns to about 12 microns.

32. The fuser member of claim 31, wherein the $Fe_2O_3$ filler particles comprise from about 10 percent by volume to about 35 percent by volume of the fusing surface layer.

* * * * *